US008466939B2

(12) United States Patent
Huang et al.

(10) Patent No.: US 8,466,939 B2
(45) Date of Patent: Jun. 18, 2013

(54) THERMAL SUBLIMATION PRINTER SYSTEM CAPABLE OF CUTTING PRINT MEDIA PRECISELY AND PRINT METHOD USING THE SAME

(75) Inventors: Yao-Hsien Huang, New Taipei (TW); Chien-Ju Chen, Keelung (TW)

(73) Assignee: HiTi Digital, Inc., Xindian Dist., New Taipei (TW)

( * ) Notice: Subject to any disclaimer, the term of this patent is extended or adjusted under 35 U.S.C. 154(b) by 114 days.

(21) Appl. No.: 13/158,467

(22) Filed: Jun. 13, 2011

(65) Prior Publication Data

US 2012/0268546 A1 Oct. 25, 2012

(30) Foreign Application Priority Data

Apr. 21, 2011 (TW) ..... 100113903 A

(51) Int. Cl.
*B41J 2/325* (2006.01)

(52) U.S. Cl.
USPC ..... 347/176; 347/217

(58) Field of Classification Search
USPC ..... 347/172, 174, 176, 218, 217
See application file for complete search history.

(56) References Cited

U.S. PATENT DOCUMENTS 4,943,812 A * 7/1990 Yokoyama et al. ..... 347/176
5,021,804 A * 6/1991 Nozawa et al. ..... 347/176
5,964,543 A * 10/1999 Sakamoto et al. ..... 400/586
6,517,190 B2 * 2/2003 Matsumoto et al. ..... 347/35
2012/0194597 A1 * 8/2012 Okamoto et al. ..... 347/16
2012/0260545 A1 * 10/2012 Desaulniers ..... 40/582

FOREIGN PATENT DOCUMENTS

JP H05319681 A 12/1993
JP H0674343 U 10/1994
JP H09174968 A 7/1997
JP H09323484 A 12/1997
JP 2002316450 A 10/2002
JP 2004-345148 * 12/2004

OTHER PUBLICATIONS

Computer-generated translation of JP 2004-345148, published on Dec. 2004.*

* cited by examiner

*Primary Examiner* — Huan Tran

(74) *Attorney, Agent, or Firm* — Winston Hsu; Scott Margo

(57) ABSTRACT

A thermal sublimation printer system for precisely cutting a print medium includes a feeding mechanism, a thermal print head, a sensor, a cutting mechanism and a control unit. The paper feeding mechanism is used for moving the print medium, and the thermal print head is used for transferring at least one dye region of a ribbon onto the print medium so as to form an image region on the print medium, correspondingly. The sensor is used for sensing a recognition mark on the print medium, and the cutting mechanism is used for cutting the print medium. The control unit is used for controlling the cutting mechanism to cut the print medium when the sensor senses the recognition mark.

13 Claims, 7 Drawing Sheets

THERMAL SUBLIMATION PRINTER SYSTEM CAPABLE OF CUTTING PRINT MEDIA PRECISELY AND PRINT METHOD USING THE SAME

BACKGROUND OF THE INVENTION

1. Field of the Invention

The present invention relates to a thermal sublimation printer system and a print method, and more particularly, to a thermal sublimation printer system capable of cutting print media precisely and a print method using the same.

2. Description of the Prior Art

A conventional thermal sublimation printer with duplex printing function utilizes a motor to drive a feeding mechanism with a rubber roller, so as to move a print medium to a position where a thermal print head is located. Afterwards, the thermal print head transfers dyes on a ribbon onto the print medium. After completing dye transferring, the motor continues to drive the feeding mechanism for moving the print medium to a position where a cutting mechanism is located. The cutting mechanism is used for cutting the print medium, so as to make a length of the print medium with a printed image be identical to that of a physical image. Consequently, and it is easy and convenient for a user to take the said cutting printed medium.

A conventional method for calculating the length for cutting the print medium is to convert movement steps of a stepping motor into the length which the print medium has been moved according to a gear ratio of a transmission system together with a radius of the rubber roller. Consequently, the thermal sublimation printer can control the cutting mechanism to cut the print medium according to the length which the print medium has been moved, so as to make the print medium meet the length of the physical image. However, both of a slip between the rubber roller and the print medium and an abnormal functioning of the stepping motor will result in error of calculating the length which the print medium has been moved. As a result, the length of the print medium with the printed image does not meet that of the physical image.

Furthermore, a conventional solution to solve issue of the slip between the rubber roller and the print medium is to use a metal roller with spurs driven by the stepping motor for holding the print medium. With the print medium being pierced by the spurs on the roller, it results in that motion between the print medium and the roller is a pure rolling without slipping. However, such kind of design will fracture the surface of the print medium so as to affect quality of printing, and even worse for duplex printing. Accordingly, design for a printing mechanism capable of cutting the print medium precisely and with good quality of printing becomes an important issue in the printer industry.

SUMMARY OF THE INVENTION

The present invention provides a thermal sublimation printer system capable of cutting print media precisely and a print method using the same for solving above drawbacks.

According to the claimed invention, a thermal sublimation printer system of the present invention includes a feeding mechanism for moving a print medium, a thermal print head for transferring at least one dye region of a ribbon onto the print medium so as to form an image region on the print medium correspondingly, a sensor for sensing a recognition mark on the print medium, the image region being away from the recognition mark by a first distance, a cutting mechanism for cutting the print medium, the cutting mechanism being away from the sensor by a second distance, and a control unit for controlling the cutting mechanism to cut the print medium when the sensor senses the recognition mark.

According to the claimed invention, the ribbon further includes at least one recognition dye region, and the thermal print head is used for transferring the at least one recognition dye region of the ribbon onto the print medium, so as to form the recognition mark on the print medium correspondingly.

According to the claimed invention, the sensor is an infrared sensor.

According to the claimed invention, the feeding mechanism is a rubber roller transmission system.

According to the claimed invention, the thermal sublimation printer system further includes a paper ejection mechanism for ejecting the print medium from the cutting mechanism.

According to the claimed invention, the first distance is substantially equal to the second distance.

According to the claimed invention, a print method for cutting a print medium precisely includes forming at least one dye region on a ribbon, utilizing a feeding mechanism to move the print medium, transferring the at least one dye region onto the print medium when the feeding mechanism is moving the print medium, so as to form an image region on the print medium correspondingly, utilizing a sensor to sense a recognition mark on the print medium, wherein the image region is away from the recognition mark by a first distance, and controlling a cutting mechanism to cut the print medium when the sensor senses the recognition mark on the print medium, wherein the cutting mechanism is away from the sensor by a second distance.

According to the claimed invention, the print method further includes forming at least one recognition dye region on the ribbon, and transferring the at least one recognition dye region onto the print medium when the feeding mechanism is moving the print medium, so as to form the recognition mark correspondingly.

According to the claimed invention, the print method further includes utilizing a paper ejection mechanism for ejecting the print medium from the cutting mechanism.

In summary, the thermal sublimation printer system and the print method of the present invention utilizes the cutting mechanism thereof to cut the print medium when the sensor senses the recognition mark. In other words, the present invention utilizes whether the sensor senses the recognition mark on the print medium for controlling the cutting mechanism to cut the print medium instead of converting movement steps of a stepping motor into the length which the print medium has been moved according to a gear ratio of a transmission system together with a radius of the rubber roller in the prior art. Consequently, the present invention can avoid issues of a slip between the rubber roller and the print medium and an abnormal functioning of the stepping motor. As a result, the present invention can utilize rubber rollers for holding and conveying the print medium for avoiding from fracturing the surface of the print medium. In such a manner, the ribbon of the present invention can enhance cutting precision of the thermal sublimation printer and keep print quality as well.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
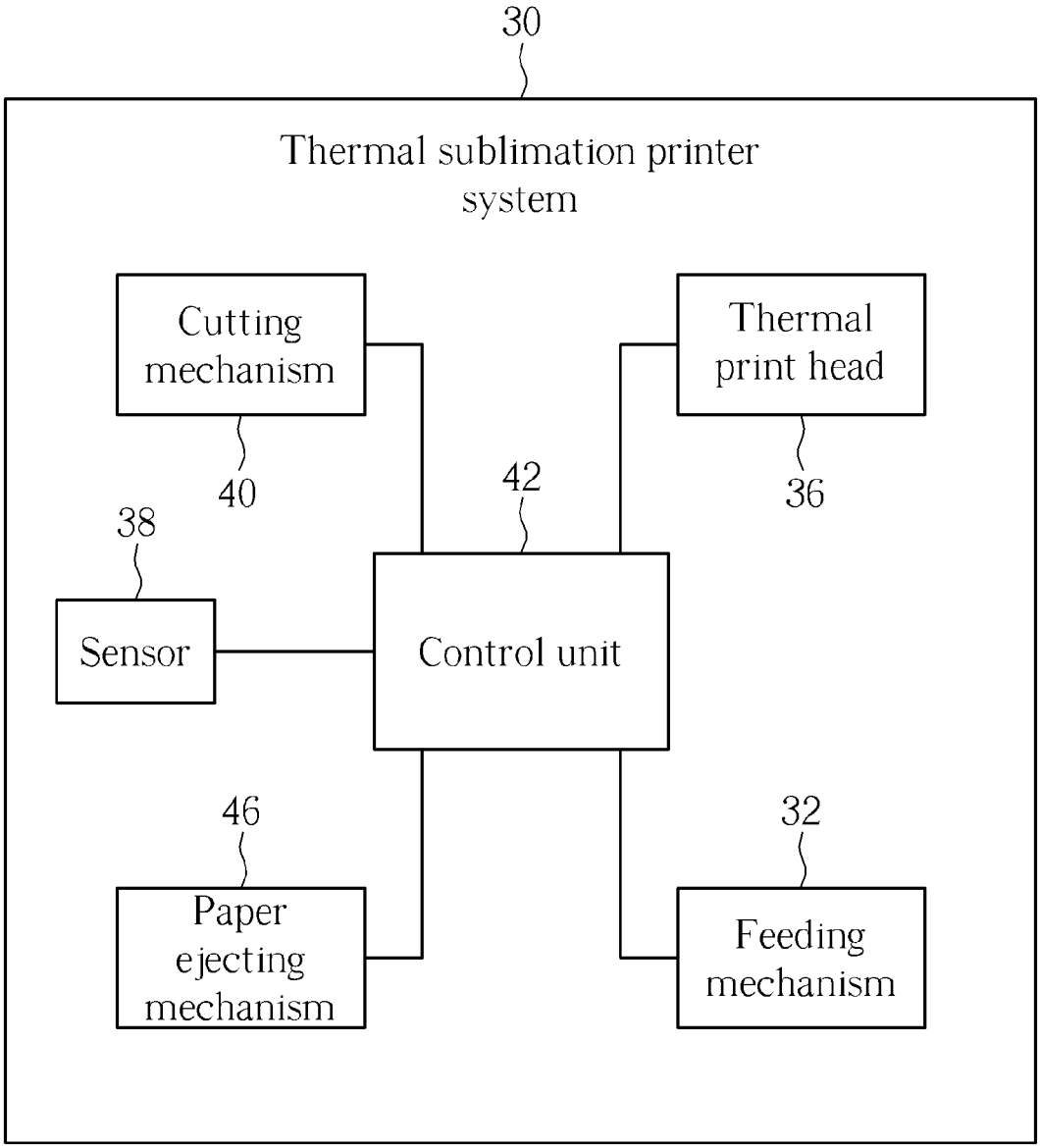
FIG. 1 is a functional block diagram of a thermal sublimation printer according to a preferred embodiment of the present invention.
Figure 2:
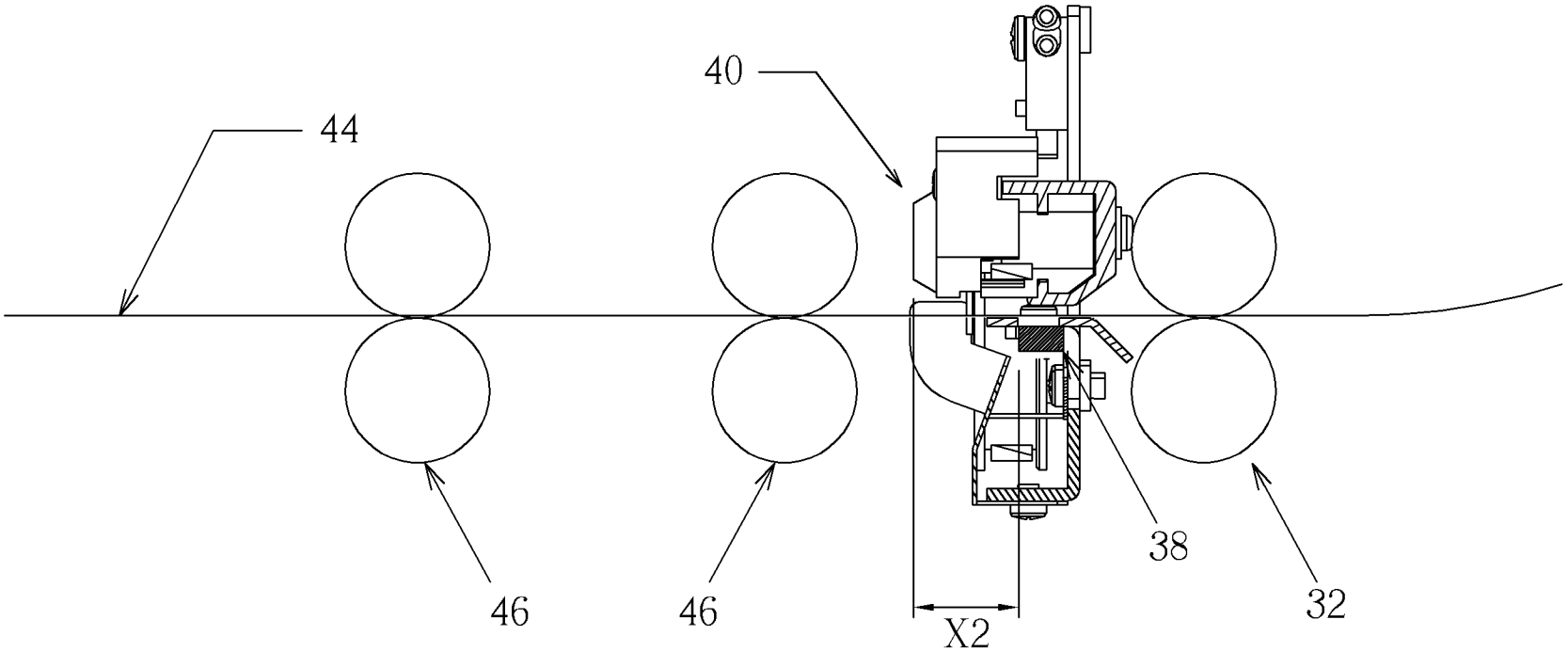
FIG. 2 is a schematic diagram of a cutting mechanism according to the preferred embodiment of the present invention.
Figure 3:
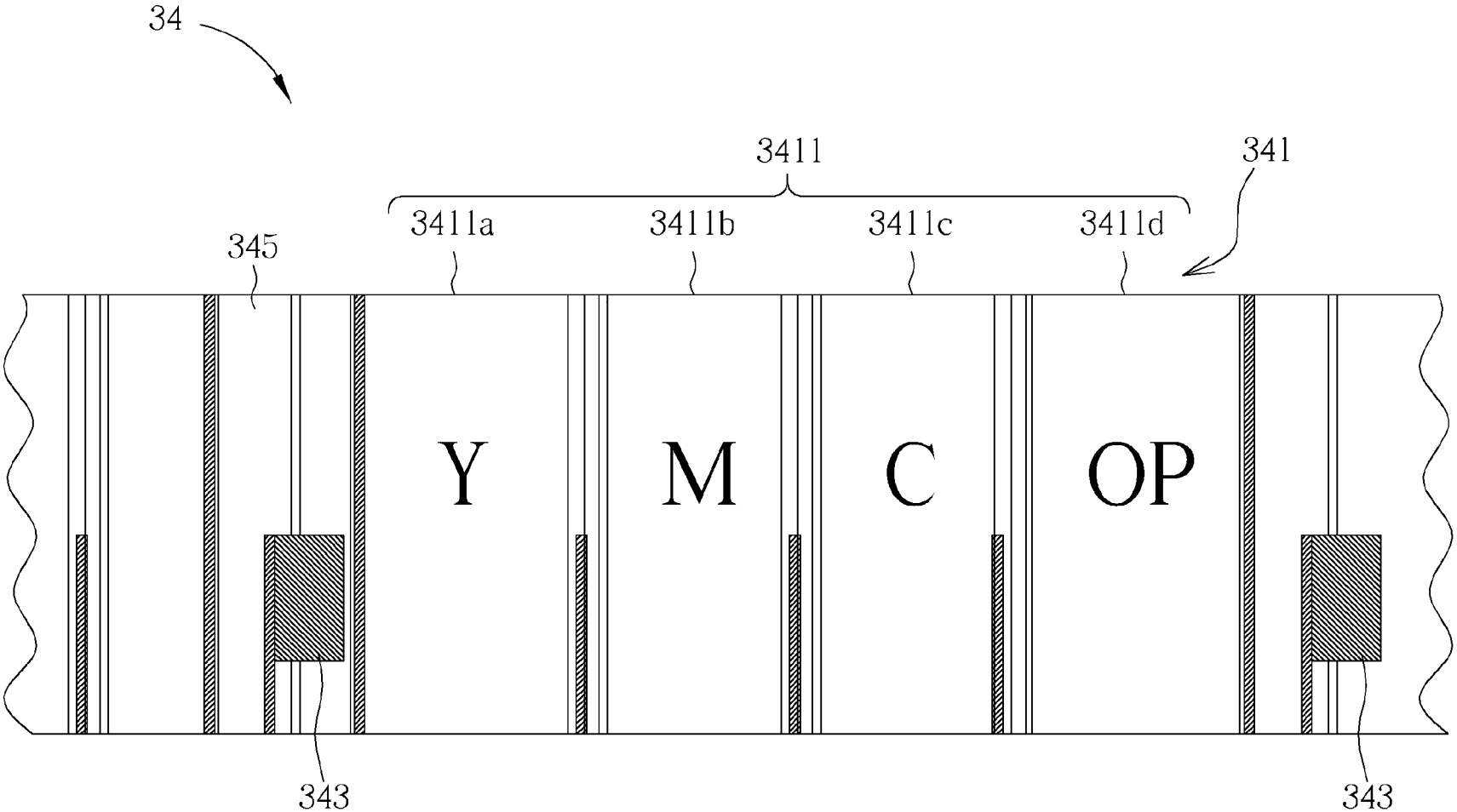
FIG. 3 is a partially schematic diagram of a ribbon according to the preferred embodiment of the present invention.

Please refer to FIG. 1. FIG. 1 is a functional block diagram of a thermal sublimation printer 30 according to a preferred embodiment of the present invention. As shown in FIG. 1, the thermal sublimation printer 30 includes a feeding mechanism 32, a thermal print head 36, a sensor 38, a cutting mechanism 40 and a control unit 42. The feeding mechanism 32 is used for moving a print medium 44 such as a sheet of paper, and the thermal print head 36 is used for transferring dyes on a ribbon 34 onto the print medium 44. Please refer to FIG. 2 and FIG. 3. FIG. 2 is a schematic diagram of the cutting mechanism 40 according to the preferred embodiment of the present invention. FIG. 3 is a partially schematic diagram of the ribbon 34 according to the preferred embodiment of the present invention. As shown in FIG. 3, the ribbon 34 can include at least one dye region 341. In this embodiment, the feeding mechanism 32 can be preferably a rubber roller transmission system for avoiding from fracturing the surface of print medium 44, so as to keep print quality.

Figure 4:
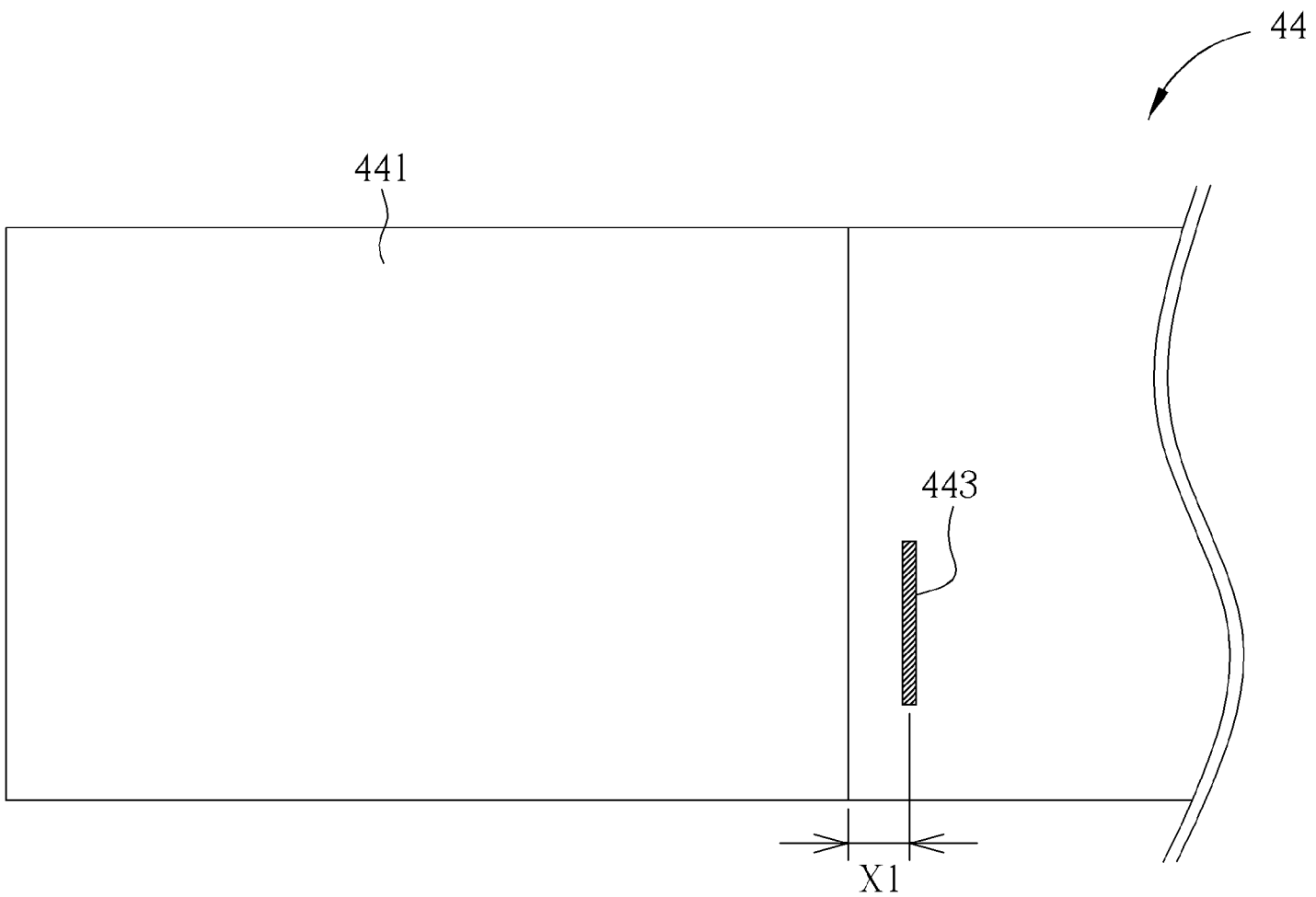
FIG. 4 is a partially schematic diagram of a print medium on a printing side according to the preferred embodiment of the present invention.

Please refer to FIG. 4 together. FIG. 4 is a partially schematic diagram of the print medium 44 on a printing side according to the preferred embodiment of the present invention. As shown in FIG. 1 to FIG. 4, the thermal print head 36 is used for transferring the at least one dye region 341 onto the print medium 44, so as to form an image region 441 on the print medium 44, correspondingly. In addition, each of the dye regions 341 can include a plurality of dye zones 3411, as four dye zones 3411 shown in FIG. 4. In practical application, the plurality of dye zones 3411 can include a yellow dye zone 3411*a*, a magenta dye zone 3411*b*, a cyan dye zone 3411*c* and an overcoating zone 3411*d*. The image region 441 can be formed in a thermal transferring manner by individually or collectively using the aforesaid plurality of dye zones 3411, as well as the corresponding protective layer on the image region 441 for protecting dyes transferred on the image region 441.

Figure 5:
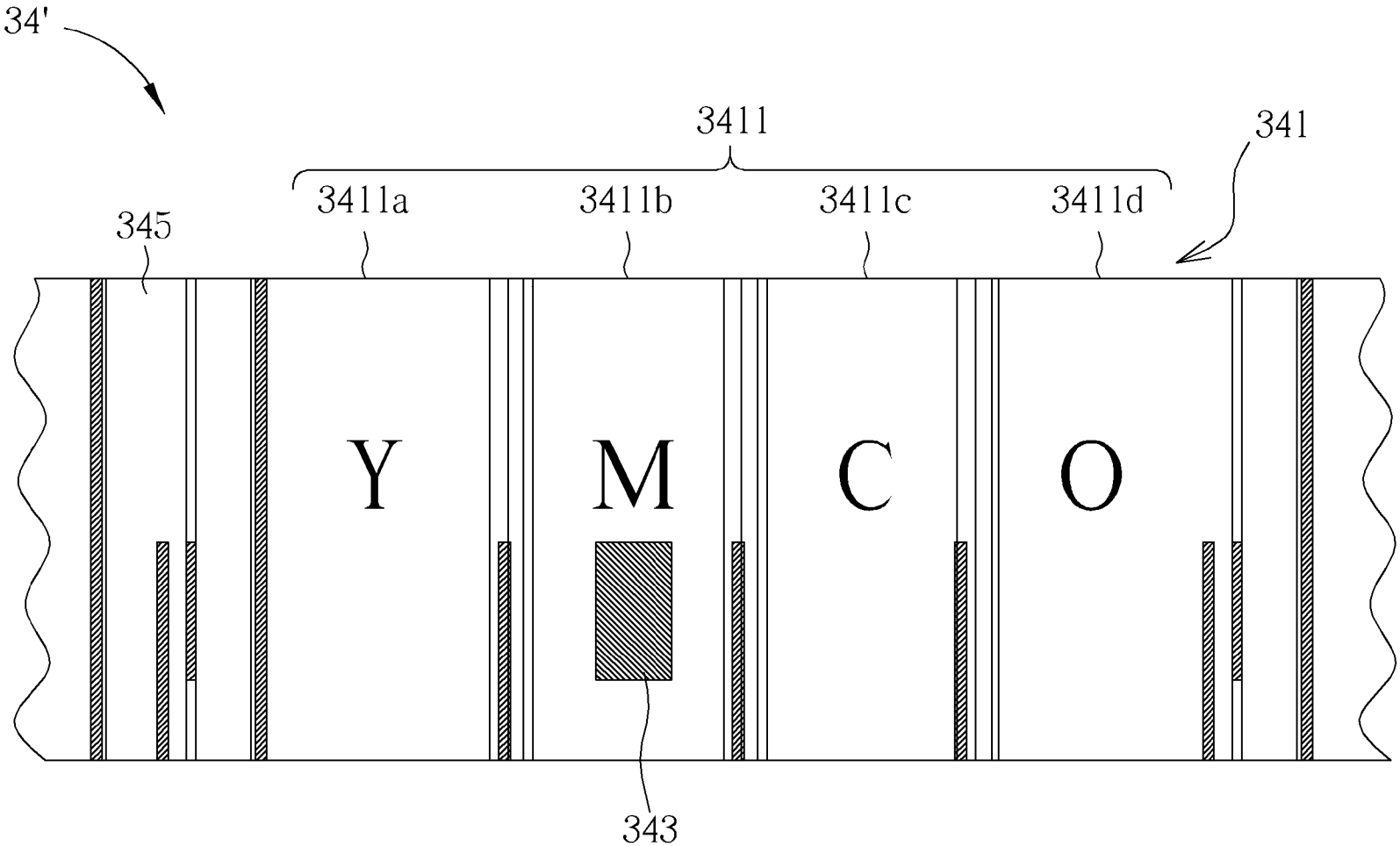
FIG. 5 is a partially schematic diagram of a ribbon according to another embodiment of the present invention.
Figure 6:
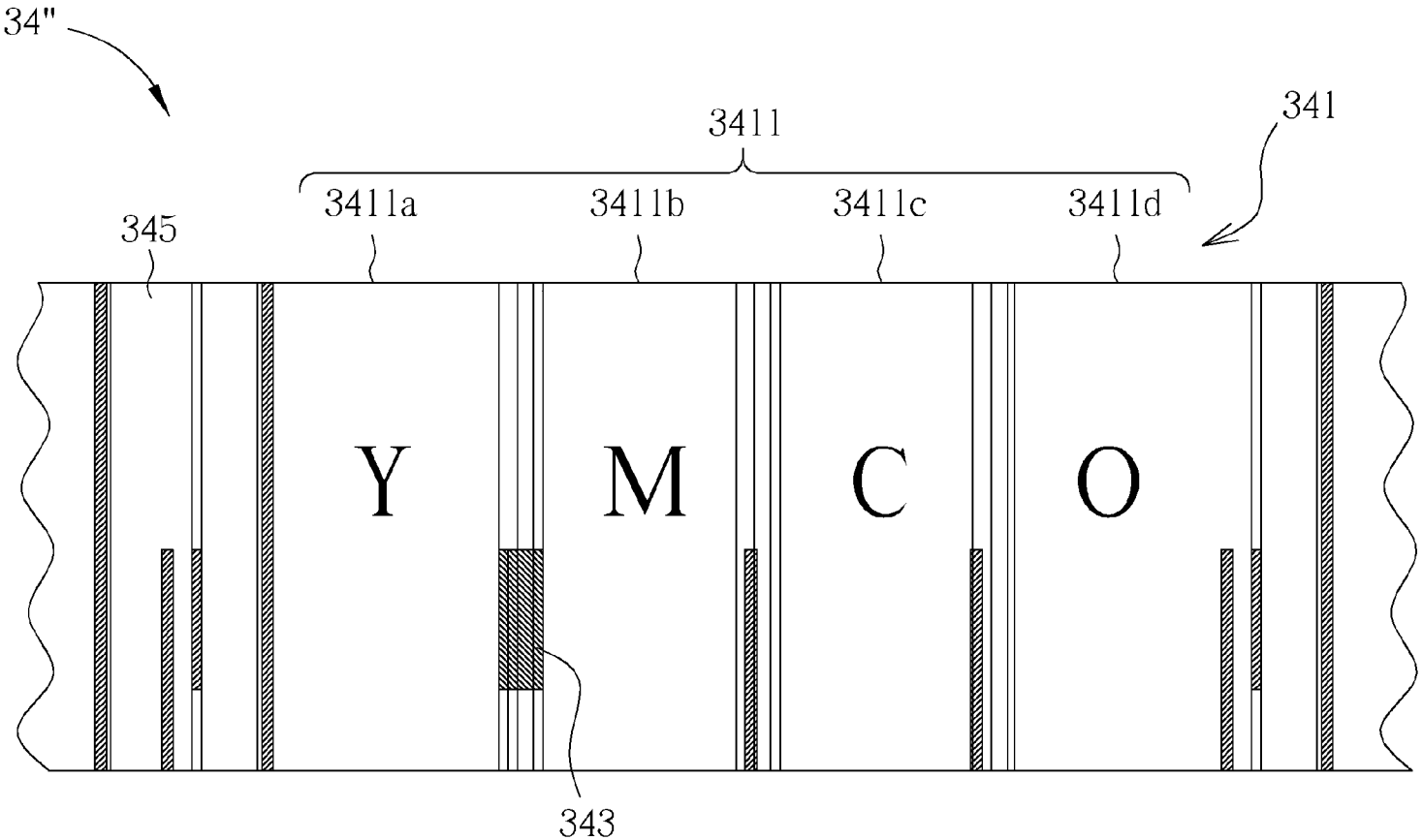
FIG. 6 is a partially schematic diagram of a ribbon according to another embodiment of the present invention.

Furthermore, the ribbon 34 further includes at least one recognition dye region 343 and at least one separating region 345. The separating region 345 is formed on a side of the dye region 341 for separating different dye regions 341. Please refer to FIG. 3 again. As shown in FIG. 3, the recognition dye region 343 is formed on the separating region 345. In other words, in this embodiment, since the separating region 345 is located between the two adjacent dye regions 341, the recognition dye region 343 is formed between the two adjacent dye regions 341 as well. It should be noticed that disposal of the recognition dye regions 343 on the ribbon 34 is not limited to that mentioned in the aforesaid embodiment. For example, please refer to FIG. 5. FIG. 5 is a partially schematic diagram of a ribbon 34' according to another embodiment of the present invention. As shown in FIG. 3 and FIG. 5, the main difference between the ribbon 34' and the aforesaid ribbon 34 is that the recognition dye region 343 as shown in FIG. 5 is formed on one of the plurality of dye zones 3411. For example, the recognition dye region 343 can be formed on the magenda dye zone 3411*b* as shown in FIG. 5. On the other hand, please refer to FIG. 6. FIG. 6 is a partially schematic diagram of a ribbon 34" according to another embodiment of the present invention. As shown in FIG. 3 and FIG. 6, the main difference between the ribbon 34" and the aforesaid ribbon 34 is that the recognition dye region 343 as shown in FIG. 6 is formed between the two adjacent dye zones 3411*a*, 3411*b*, 3411*c*, 3411*d*. In other words, the recognition dye region 343 can be formed on the separating region 345 or be formed within a range covered by the corresponding dye region 341. As for which design of the above-mentioned recognition dye region 343 is adopted, it depends on practical demands.

In practical application, the recognition dye region 343 can be made of a dark-color dye capable of absorbing an infrared ray. For example, the dark-color dye can be made of K-Resin material. Furthermore, the thermal print head 36 can transfer the recognition dye region 343 on the ribbon 34 onto the print medium 44, so as to form a recognition mark 443. The image region 441 is away from the recognition mark 443 by a first distance X1. It should be noticed that the way to form the recognition mark 443 on the print medium 44 of the present invention is not limited to those mentioned in the above-mentioned embodiment. For example, the recognition mark 443 can be formed directly on the print medium 44 instead of transferring the recognition dye region 343 on the ribbon 34 thereon by the thermal print head 36, which is mentioned in the aforesaid embodiment.

In addition, the sensor 38 of the thermal sublimation printer 30 of the present invention is used for sensing the recognition mark 443 on the print medium 44, and the cutting mechanism 40 is used for cutting the print medium 44. The sensor 38 is away from the cutting mechanism 40 by a second distance X2. In practical application, the sensor 38 can preferably be an infrared sensor, and the first distance X1 can be substantially equal to the second distance X2. In addition, the thermal sublimation printer 30 can further include a paper ejecting mechanism 46 for driving the print medium 44 to depart from the cutting mechanism 40, so as to avoid paper jam when utilizing the thermal sublimation printer 30 for printing and cutting. In practical application, the paper ejecting mechanism 46 can preferably be a rubber roller transmission mechanism.

Figure 7:
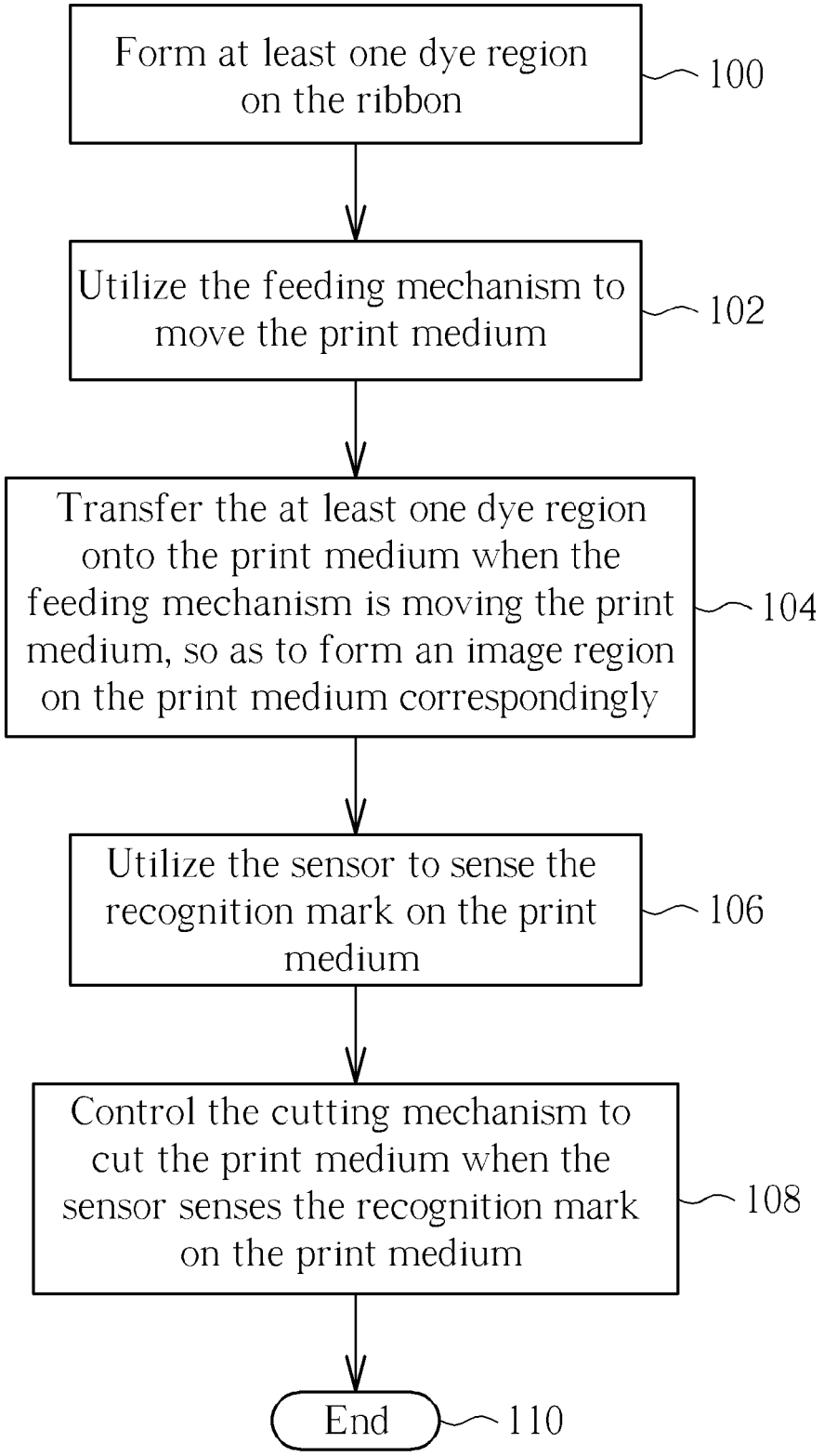
FIG. 7 is a flow chart of a print method according to the preferred embodiment of the present invention.

More detailed description for a print method of cutting the print medium 44 precisely is provided as follows. Please refer to FIG. 7. FIG. 7 is a flow chart of the print method according to the preferred embodiment of the present invention. As shown in FIG. 7, the print method includes following steps:

Step 100: Form at least one dye region 341 on the ribbon 34.

Step 102: Utilize the feeding mechanism 32 to move the print medium 44.

Step 104: Transfer the at least one dye region 341 onto the print medium 44 when the feeding mechanism 32 is moving the print medium 44, so as to form an image region 441 on the print medium 44 correspondingly.

Step 106: Utilize the sensor 38 to sense the recognition mark 443 on the print medium 44.

Step 108: Control the cutting mechanism 40 to cut the print medium 44 when the sensor 38 senses the recognition mark 443 on the print medium 44.

Step 110: End.

At first, the at least one dye region 341 is formed on the ribbon 34 of the thermal sublimation printer system 30. During printing process, the feeding mechanism 32 of the thermal sublimation printer system 30 moves the print medium 44. Further, the thermal print head 36 transfers the dye regions 341 on the ribbon 34 onto the print medium 44 in a thermal printing manner when the feeding mechanism 32 is moving the print medium 44, so as to form the image region 441 on the print medium 44, correspondingly.

As for cutting the print medium 44, the control unit 42 controls the cutting mechanism 40 to cut the print medium 44 when the sensor 38 senses the recognition mark 443 on the print medium 44. At the same time, the cut print medium 44 is driven by the paper ejecting mechanism 46 to depart from the cutting mechanism 40. Since the first distance X1 between the image region 441 and the recognition mark 443 is substantially equal to the second distance X2 between the sensor 38 and the cutting mechanism 40, a cutting position for the cutting mechanism 40 is right at an end of the image region 441 when the sensor 38 senses the recognition dye region 343 on the print medium 44. In such a manner, a length of the cut print medium 44 is precisely identical to a length of the image region 441 on the print medium 44, so as to enhance cutting precision for cutting the print medium 44.

Compared with the prior art, the thermal sublimation printer system and the print method of the present invention utilizes the cutting mechanism thereof to cut the print medium when the sensor senses the recognition mark. In other words, the present invention utilizes whether the sensor senses the recognition mark on the print medium for controlling the cutting mechanism to cut the print medium instead of converting movement steps of a stepping motor into the length which the print medium has been moved according to a gear ratio of a transmission system together with a radius of the rubber roller in the prior art. Consequently, the present invention can avoid issues of a slip between the rubber roller and the print medium and an abnormal functioning of the stepping motor. As a result, the present invention can utilize rubber rollers for holding and conveying the print medium for avoiding from fracturing the surface of the print medium. In such a manner, the ribbon of the present invention can enhance cutting precision of the thermal sublimation printer and keep print quality as well.

Those skilled in the art will readily observe that numerous modifications and alterations of the device and method may be made while retaining the teachings of the invention.

What is claimed is:

1. A thermal sublimation printer system comprises:

a feeding mechanism for moving a print medium;

a ribbon comprising at least one dye region and at least one recognition dye region;

a thermal print head for transferring the at least one dye region and the at least one recognition dye region of the ribbon onto the print medium, so as to form an image region and a recognition mark on the print medium correspondingly;

a sensor for sensing the recognition mark on the print medium, the image region being away from the recognition mark by a first distance;

a cutting mechanism for cutting the print medium, the cutting mechanism being away from the sensor by a second distance; and a control unit for controlling the cutting mechanism to cut the print medium when the sensor senses the recognition mark.

2. The thermal sublimation printer system of claim 1, wherein the sensor is an infrared sensor.

3. The thermal sublimation printer system of claim 1, wherein the feeding mechanism is a rubber roller transmission system.

4. The thermal sublimation printer system of claim 1, further comprising a paper ejection mechanism for ejecting the print medium from the cutting mechanism.

5. The thermal sublimation printer system of claim 1, wherein the first distance is substantially equal to the second distance.

6. A print method for cutting a print medium precisely, comprising:

forming at least one dye region on a ribbon;

forming at least one recognition dye region on the ribbon;

utilizing a feeding mechanism to move the print medium;

transferring the at least one dye region onto the print medium when the feeding mechanism is moving the print medium, so as to form an image region on the print medium correspondingly;

transferring the at least one recognition dye region onto the print medium when the feeding mechanism is moving the print medium, so as to form a recognition mark correspondingly;

utilizing a sensor to sense the recognition mark on the print medium, wherein the image region is away from the recognition mark by a first distance; and controlling a cutting mechanism to cut the print medium when the sensor senses the recognition mark on the print medium, wherein the cutting mechanism is away from the sensor by a second distance.

7. The print method of claim 6, further comprising:

utilizing a paper ejection mechanism for ejecting the print medium from the cutting mechanism.

8. The print method of claim 6, wherein the first distance is substantially equal to the second distance.

9. A ribbon adapted to a thermal sublimation printer, the thermal sublimation printer comprising a thermal print head, a sensor and a cutting mechanism, the ribbon comprising:

at least one dye region comprising a plurality of dye zones;

at least one separating region formed on a side of the at least one dye region for separating different dye regions; and at least one recognition dye region formed on the at least one separating region or formed within a range covered by the corresponding at least one dye region;

wherein the thermal print head of the thermal sublimation printer transfers the at least one dye region and the at least one recognition dye region of the ribbon onto a print medium, so as to form an image area and a recognition mark on the print medium correspondingly, and the cutting mechanism of the thermal sublimation printer cuts the print medium when the sensor of the thermal sublimation printer senses the recognition mark.

10. The ribbon of claim 9, wherein the at least one recognition dye region is made of a dark-colored dye capable of absorbing an infrared ray.

11. The ribbon of claim 10, wherein the dark-colored dye is made of styrene butadiene impact resin material.

12. The ribbon of claim 9, wherein the at least one recognition dye region is formed between two dye zones of the plurality of dye zones.

13. The ribbon of claim 9, wherein the plurality of dye zones comprises a yellow dye zone, a magenda dye zone, a cyan dye zone and an overcoating zone.

* * * * *